US006764321B2

(12) United States Patent
Machado

(10) Patent No.: US 6,764,321 B2
(45) Date of Patent: Jul. 20, 2004

(54) GROUND POTENTIAL ONLY ADAPTOR

(75) Inventor: David A. Machado, Taw Hill (GB)

(73) Assignee: Sun Microsystems, Inc., Santa Clara, CA (US)

( * ) Notice: Subject to any disclaimer, the term of this patent is extended or adjusted under 35 U.S.C. 154(b) by 0 days.

(21) Appl. No.: 10/200,027

(22) Filed: Jul. 19, 2002

(65) Prior Publication Data

US 2004/0014339 A1 Jan. 22, 2004

(51) Int. Cl.[7] ..... H01R 4/66; H01R 13/648
(52) U.S. Cl. ..... 439/105
(58) Field of Search ..... 439/105, 108, 439/638, 92, 96

(56) References Cited

U.S. PATENT DOCUMENTS 3,626,354 A * 12/1971 Banner ..... 439/105
3,924,914 A * 12/1975 Banner ..... 439/105
3,985,412 A * 10/1976 Hoffman ..... 439/105
4,085,996 A * 4/1978 Koslo ..... 439/105
4,111,516 A * 9/1978 Wireman ..... 439/490
4,293,172 A * 10/1981 Lingaraju ..... 439/105
4,313,148 A * 1/1982 Turner ..... 361/212
6,514,093 B1 * 2/2003 Yu ..... 439/105

* cited by examiner

*Primary Examiner*—Javaid H. Nasri
(74) *Attorney, Agent, or Firm*—Meyertons Hood Kivlin Kowert & Goetzel, P.C.; B. Noël Kivlin

(57) ABSTRACT

There is described a servicing connection for connecting an electrical device to a supply outlet, wherein live and neutral contacts of the supply outlet are isolated from live and neutral contacts of the device, but a connection is maintained between earth contacts of the supply and the device. The connection may be embodied as an adaptor for interposition between a conventional supply outlet and a conventional power inlet of the device, or may be in the form of a power inlet capable of receiving a supply cord in alternative "servicing" and "operation" positions. There is also described a connection in the form of a power cord for use with a conventional power inlet, and having an additional connector engageable with the power inlet to make an earth connection only.

6 Claims, 7 Drawing Sheets

FIG. 4
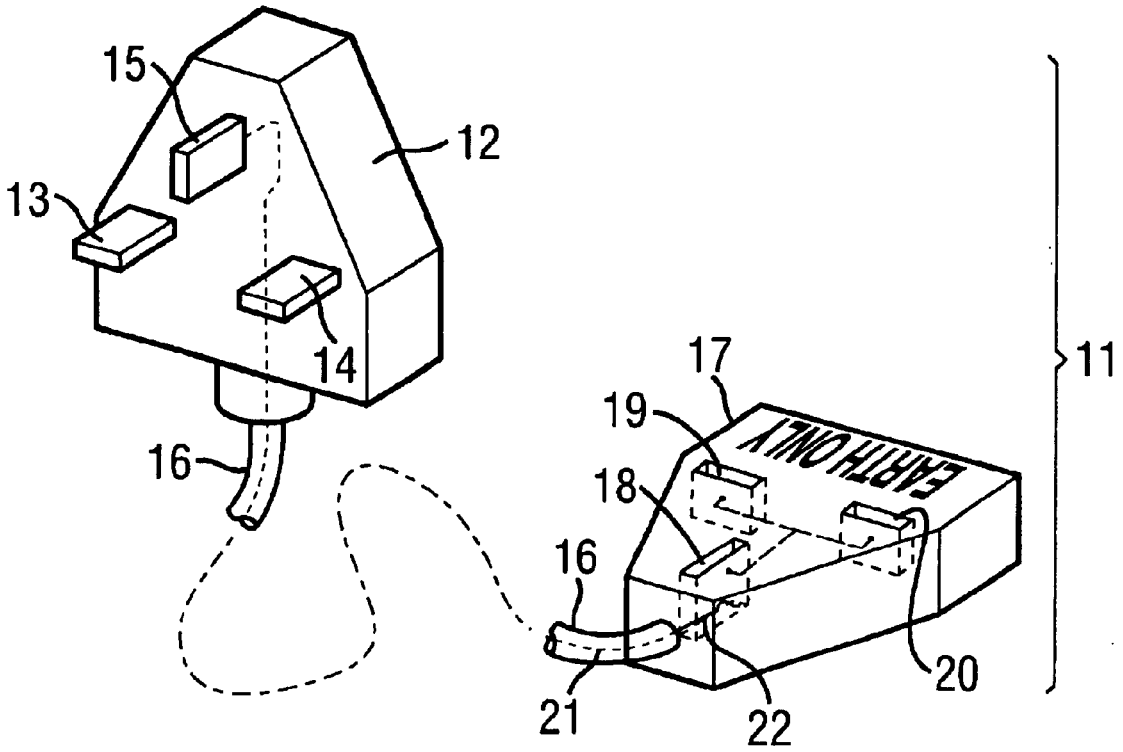
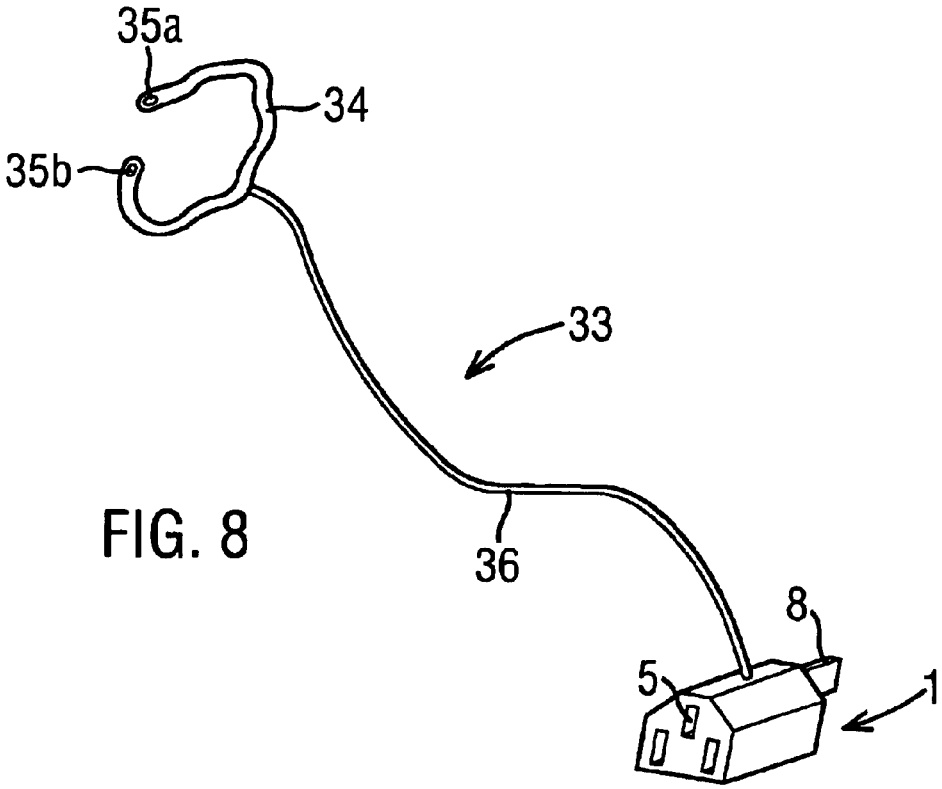
FIG. 8

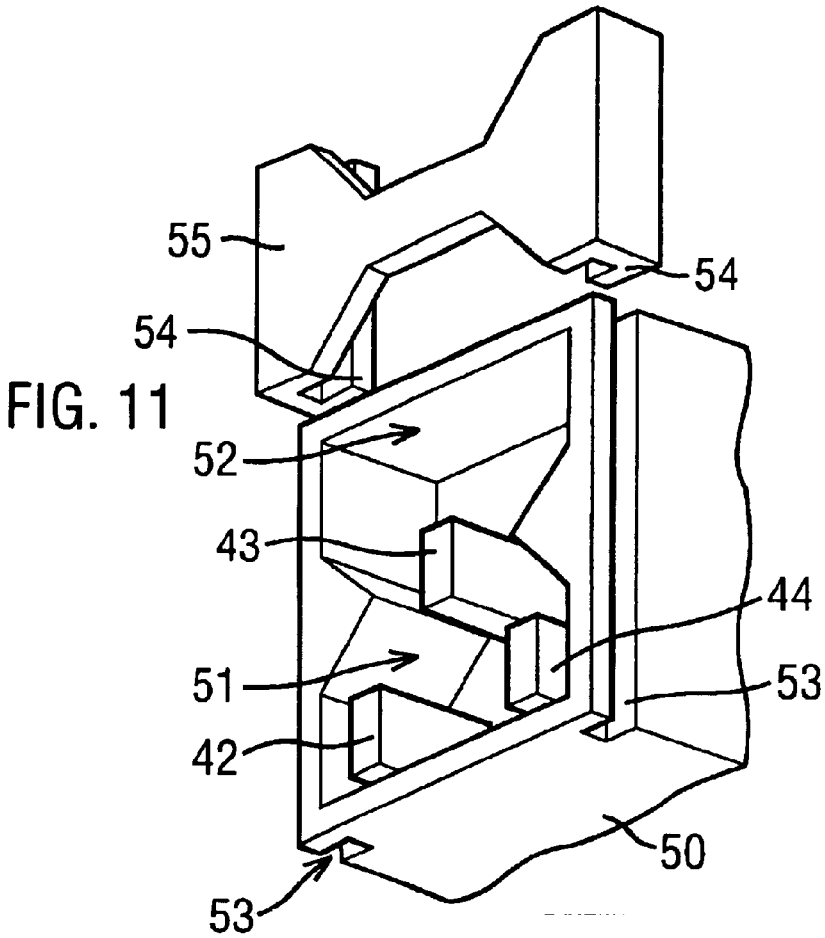
FIG. 11
FIG. 12
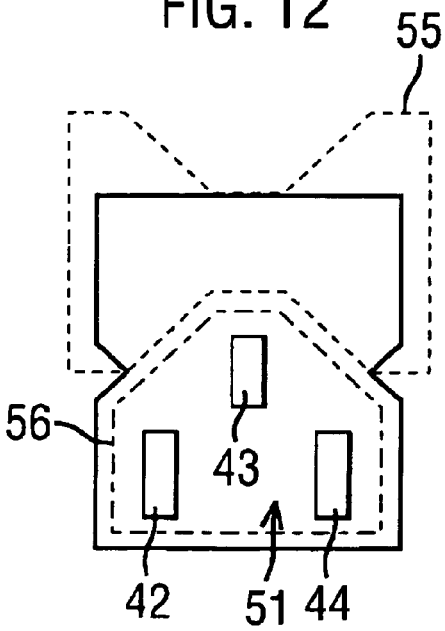
FIG. 13
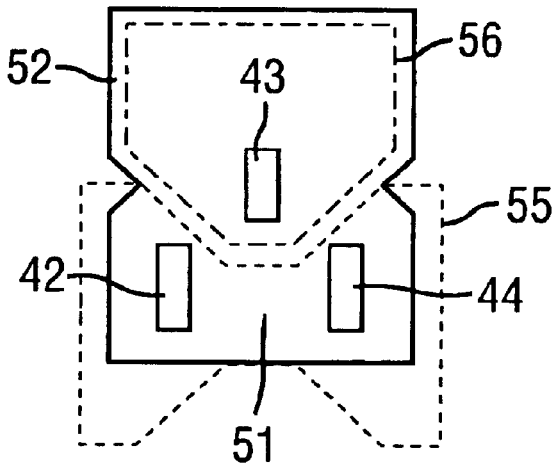

GROUND POTENTIAL ONLY ADAPTOR

BACKGROUND OF THE INVENTION

The present invention relates to electrical equipment, and particularly concerns apparatus and methods for the effective grounding or earthing of electrical equipment while the equipment is isolated from a mains supply during repair or maintenance.

Electrical installations such as computers, network servers and the like are conventionally supplied with electricity from a mains supply. The connection to the mains supply comprises a live and a neutral connection supplying the electrical power, and a ground or earth connection which is connected to the chassis of the equipment. The electrical connectors of the mains supply are in the form of female sockets having recesses to accept the projections of a male plug associated with the equipment. The male plug may be at one end of a cord whose other end is permanently connected to the equipment. Alternatively, the male plug may be a so-called "ac inlet" fixedly mounted to the equipment, and the connection between the plug of the equipment and the socket of the mains supply may be made by means of a cord having a cord plug at one end and a cord socket at the other, the cord plug being compatible with the mains socket, and the cord socket being compatible with the plug or "ac inlet" of the equipment.

When repair or maintenance is to be carried out on an electrical apparatus, it is conventional to ensure the safety of the operative by disconnecting the apparatus from the mains supply, either by disconnecting the plug from the mains socket, or by removing the cord socket from the plug of the apparatus. This not only isolates the equipment from the mains voltage, but also removes the ground or earth connection to the chassis of the equipment.

The repair of semiconductor circuits however requires the operative to be able to access a secure ground connection, in order to avoid the accumulation of electrostatic charges which may damage sensitive semiconductor devices. Conventionally a connection point is provided on the apparatus chassis for the service operative to connect one end of an earthing strap, the other end of which is attached to the operative. The connection point may be a conductive button or socket fixed to the chassis, or may be a bare metal area of the chassis to which the strap is attached by a crocodile clip or the like. However, there is no standard position for such a connection point on the chassis of electrical apparatus, and the operative often has to spend time to locate the connection point. Furthermore, when the power cord is disconnected from the apparatus, the earth connection to the chassis is severed, and even if the service operative is connected to the chassis by an earth strap, neither may be reliably earthed.

The repair operative is therefore faced with the choice of disconnecting the mains cable and losing the secure ground connection, or leaving the equipment connected to the mains to ensure a ground connection, but risking exposure to internal components of the equipment at mains voltages.

A need therefore exists for a device which can effectively isolate an electrical apparatus from the mains voltage, while maintaining the ground or earth connection to the apparatus.

SUMMARY OF THE INVENTION

One embodiment of the present invention provides an adaptor device connectable between a plug of an electrical apparatus having live, neutral and earth (ground) connectors and a mains supply socket having live, neutral and earth (ground) connectors, the adaptor device having a first interface compatible with the mains supply socket and having an earth contact electrically connectable to the earth connector of the mains supply, and a second interface compatible with the plug and having an earth contact electrically connectable to the earth connector of the plug, the adaptor device further comprising an electrical conductor connecting only the earth contacts of the first and second interfaces, and maintaining live and neutral connectors of the mains supply isolated from the equipment.

The adaptor may be in the form of an elongate component having the first and second interfaces at first and second ends of the component. Alternatively, the adaptor may comprise a plug compatible with a mains socket and a socket compatible with the plug of the equipment, connected together by a cord providing electrical connection only between earth contacts of the plug and socket, respectively.

The adapter may be further provided with third and fourth interfaces respectively configured to be compatible with a mains supply and a plug of different configurations from those compatible with the first and second interfaces.

The adaptor of the invention enables the operative and the apparatus to be reliably earthed, while isolating the apparatus from the mains voltage.

In a particular embodiment, the adapter may be provided with a stud, socket and/or clip electrically connected to the earth contacts of the adapter, for attaching one end of an earthing strap to the adaptor. The operative can then easily locate the attachment point for the earthing strap, and time spent searching for the attachment point can be saved.

In a further particular embodiment, an earthing strap may be provided at one end with a band, clip or other formation to attach to a service operative, and at the other end with an adapter as described above.

In a yet further embodiment of the adapter, the interface compatible with the apparatus plug may include recesses to receive the live and neutral contacts, respectively, of the apparatus plug, and an electrical conductor to connect the recesses together, so that when the adapter is applied to the apparatus, the live and neutral pins of the apparatus plug are electrically connected together.

In a yet further embodiment of the adapter, the interface compatible with the apparatus plug may include recesses to receive the live and neutral contacts, respectively, of the apparatus plug, and an electrical conductor to connect the sockets together and to the earth connection, so that when the adapter is applied to the apparatus, the live and neutral pins of the apparatus plug are electrically connected together and to earth.

In a further embodiment of the invention there is provided a mains cord for an electrical apparatus having a power inlet, the mains cord having at one end a first interface compatible with an electricity supply socket and at its other end a second interface compatible wiht the power inlet of the apparatus and electrical conductors to connect respectively live, neutral and earth contacts of the first and second interfaces together, the mains cord being further provided with a third interface compatible with either the electricity supply outlet or with the power inlet wherein only an earth contact of the third interface is electrically connected to the earth contacts of the first and second interfaces, and live and neutral contacts of the third interface are electrically isolated from the live and neutral contacts of the first and second interfaces. In a particular development of this embodiment, the live and neutral contacts of the third interface may be electrically connected together and/or to the earth contact. The third interface may be at the one end of the cord, and take the form of a conventional mains plug, or alternatively the third interface may be at the other end of the mains cord and take the form of a cord socket.

A further aspect of the invention concerns an enclosure for electronic circuitry which includes a mains inlet having contacts to engage live, earth and neutral contacts in a connector of a power cord, the mains inlet being so configured that the power cord connector (cord socked) may be engaged therewith in a first configuration in which contact is made with all three of the live, neutral and earth contacts of the connector, and in a second configuration wherein contact is made only with the earth conntact. In a first embodiment of this aspect, the mains inlet is provided with two plug formations engageable with the mains connector lead, one of the plug formations having three contacts and the other plug formation having a single contact to engage the earth contact of the connection cord. In a second embodiment of this aspect, the mains inlet has three electrical contacts, and is so configured that the connection cord may be engaged in a first orientation wherein connection is made with the earth, live and neutral contacts, and in a second orientation wherein connection is only made with the earth contact of the mains inlet.

The invention further provides a method of servicing or repairing a mains-powered electrical apparatus using the adapter and/or earth strap as described above.

BRIEF DESCRIPTION OF THE DRAWINGS

Embodiments of the invention will now be described in detail with reference to the accompanying drawings, in which corresponding parts are given like reference numbers. In the drawings:

FIG. 4 is a perspective view of a second adaptor according to the invention.

FIG. 8 shows an earthing strap with integral isolating adaptor;

FIG. 11 is a perspective view of an alternative equipment plug;

FIGS. 12 and 13 show schematically two different connection configurations for the plug of FIG. 11.

DESCRIPTION OF PARTICULAR EMBODIMENTS

Figure 1:
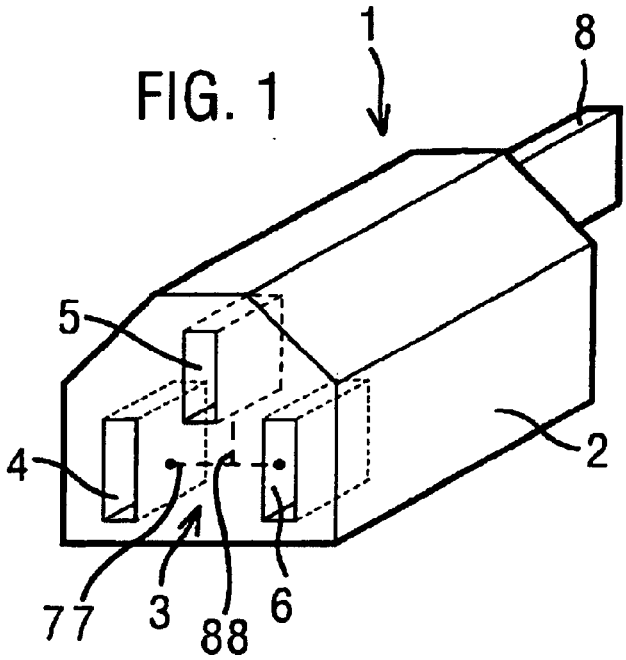
FIG. 1 is a perspective view of one end of a first adaptor according to the invention.
Figure 2:
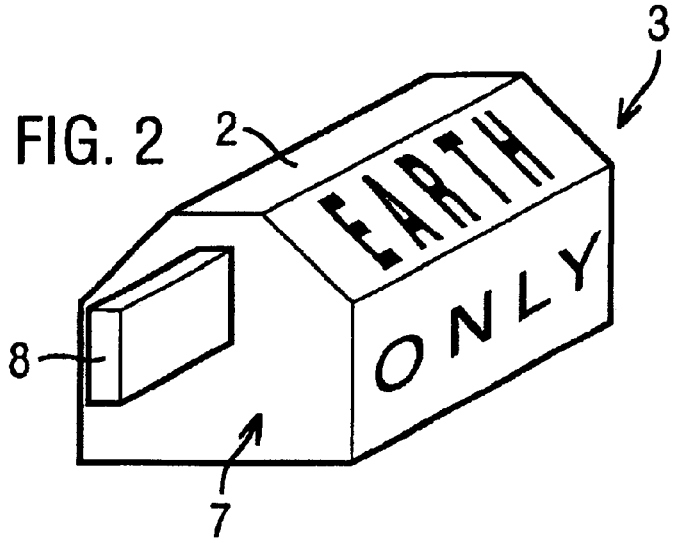
FIG. 2 is a perspective view of the other end of the adaptor of FIG. 1.
Figure 3:
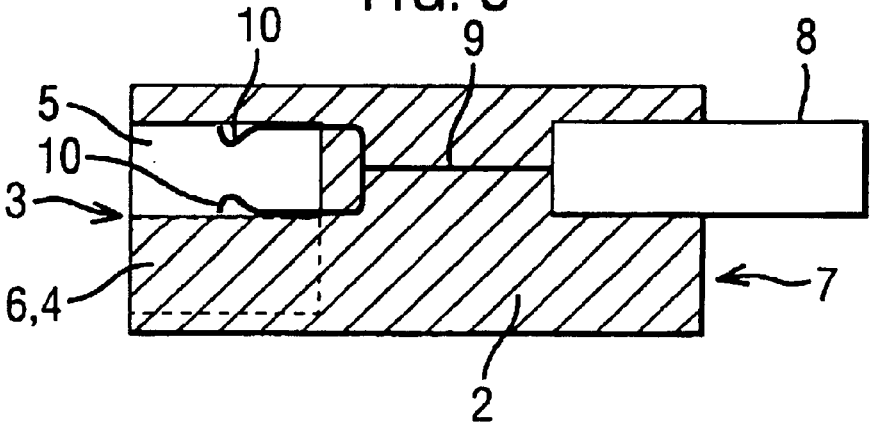
FIG. 3 is a schematic longitudinal sectional view of the adaptor of FIGS. 1 and 2.

Referring now to the drawings, FIGS. 1 to 3 illustrate a first embodiment of the ground potential only adaptor, intended for use on electrical equipment which has a recessed three-pin plug, and is connectable to a mains supply by means of a detachable cord having a cord socket.

The recessed plug of the equipment, also known as an "ac inlet", comprises a prismatic recess having an end surface from which live, neutral and earth pins project parallel to the axis of the recess. The cord socket has a prismatic body shaped to coincide with the prismatic recess of the plug, and has an end face with openings to accept the pins of the plug. Electrical connections are positioned within the openings and are connected to conductors in the mains cord.

The adaptor 1 shown in FIG. 1 comprises a prismatic body 2 of the same cross-section as the cord socket, and has an end surface 3 with recesses 4, 5 and 6 shaped and positioned to accept the three connector pins of the equipment plug (ac inlet).

A second end surface 7 of the body 2 opposite the first end surface 3 has an earth pin 8 projecting therefrom. The earth pin 8 is aligned axially with the recess 5 of end surface 3 of the body 2.

As can be seen in FIG. 3, an electrical conductor 9 extends axially from the earth pin 8 to a pair of contacts 10 situated within the recess 5.

In order to service an electrical device, the service operative first disconnects the mains cord from the device, exposing the pins of the ac inlet mounted to the equipment. The end face 3 of the adaptor 1 is then introduced into the recess of the equipment plug, so that the live and neutral pins of the equipment plug enter recesses 4 and 6, and the earth pin of the equipment plug enters the recess 5, and engages the contacts 10 to make a secure electrical connection. The socket of the mains cord is then offered up to second end surface 7 of the adaptor, so that the earth pin 8 can enter the earth connection of the cord socket. The second end surface 7 of the adaptor may be partially or completely surrounded by a shroud or peripheral wall, to ensure correct alignment of the adaptor and the cord socket. This will prevent the earth pin 8 of the adaptor from being inserted into the live or neutral connection of the cord socket. As an alternative to a shroud, insulating pins may be provided on end surface 7 to enter the live and neutral connections of the cord socket, thus ensuring that the adaptor and cord socket are correctly connected. When this connection is complete, the equipment is both effectively earthed through the earth connection of the mains cable, but is also effectively isolated from the mains voltage since no connections are made to the live and neutral pins of the equipment plug.

FIG. 4 illustrates and alternative embodiment of an adaptor, this adaptor being interposed between the mains outlet socket of a building and the power cord of the equipment to be serviced. The adaptor 11 of FIG. 4 comprises a conventional mains plug compatible with the local electricity supply, and having live, neutral and earth pins 13, 14 and 15 to engage the connectors of the mains socket.

A cable 16 connects the plug 12 to a trailing socket 17, which has recesses 18, 19 and 20 to accept the pins 15, 13 and 14 respectively of a conventional mains plug such as 12.

As is shown schematically in FIG. 4, the earth pin 15 of the plug 12 is electrically connected to the recess 18 of the trailing socket 17 by an electrical conductor 21 leading to a contact 22 in the recess 18.

The adaptor 11 of FIG. 4 is intended for use on equipment which has its mains cable permanently attached to the equipment at the proximal end, and has a conventional mains plug at the distal end. In order to service the equipment, the service operative removes the plug of the equipment cord from the mains socket, and inserts the plug of the equipment into the trailing socket 17 so that the earth pin of the equipment plug enters the recess 18 and engages the contact 22. The plug 12 of the adaptor 11 is then inserted into the mains socket of the building, and earth pin 13 of plug 12 makes a connection with the earth provided in the mains socket. The equipment is thus effectively earthed, and also isolated from the mains voltage.

Figure 5:
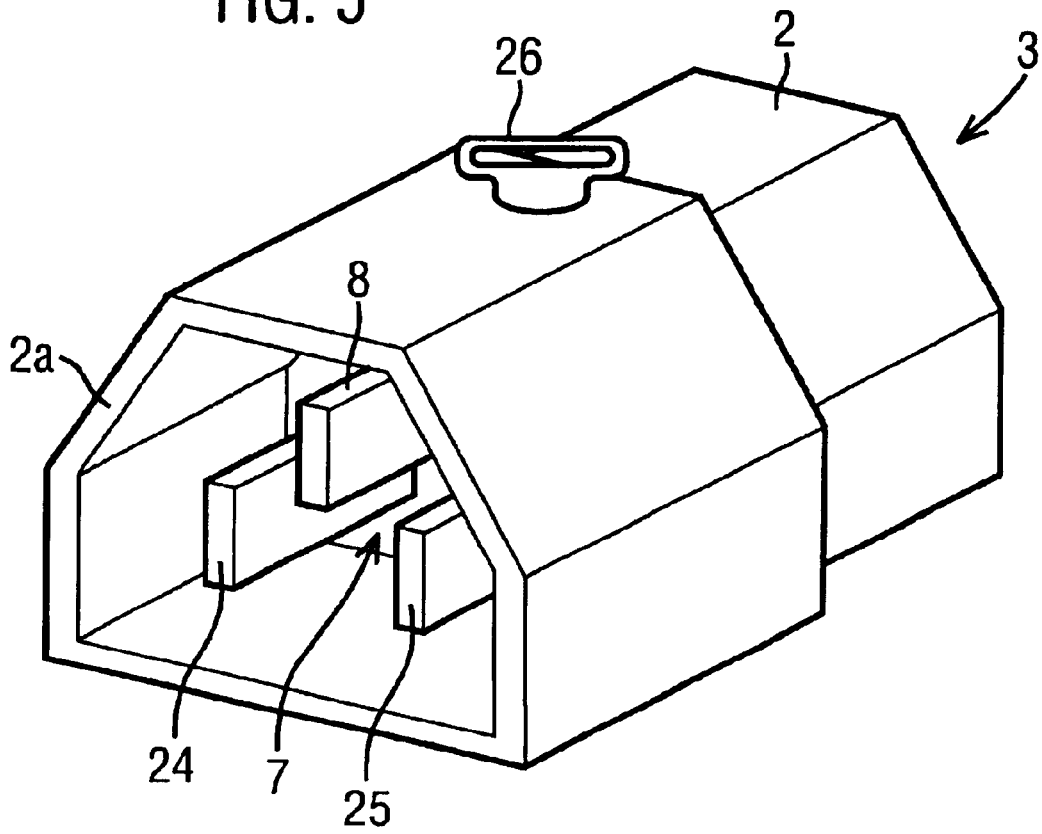
FIG. 5 is a perspective view of one end of a third adaptor according to the invention.
Figure 6:
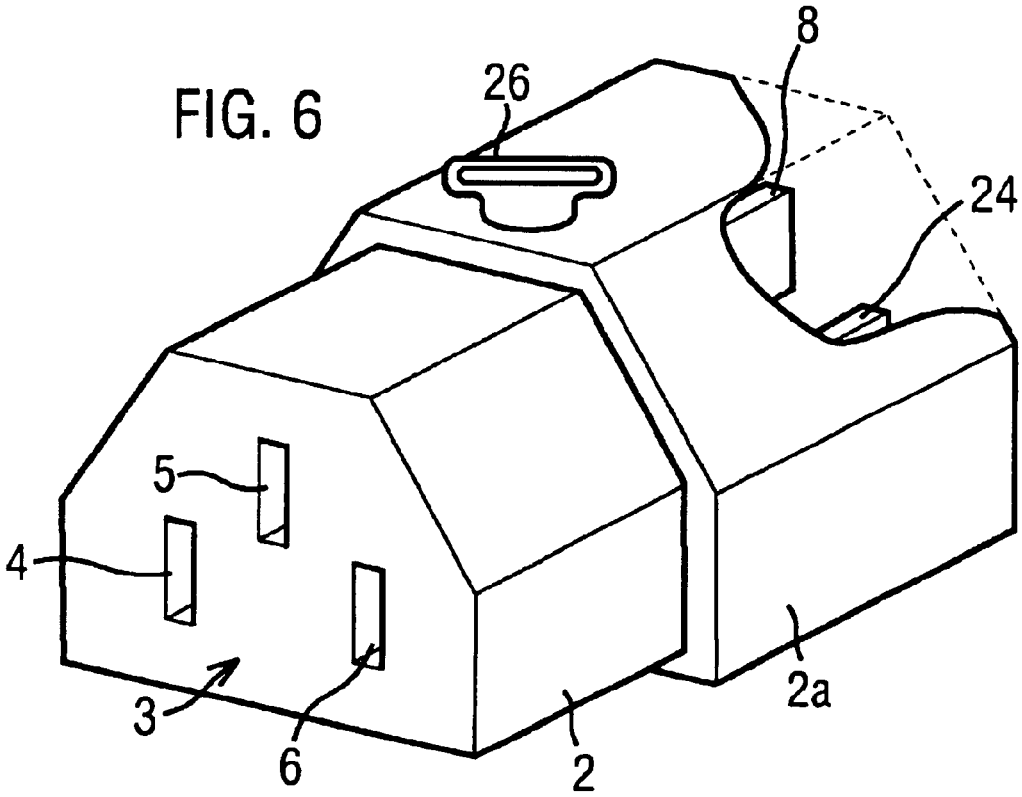
FIG. 6 is a perspective view partially cut away of the other end of the adaptor of FIG. 5.

FIGS. 5 and 6 show an adaptor similar to that of FIGS. 1 to 3. In FIGS. 5 and 6, the body 2 is provided with a tubular shroud 2*a* extending axially beyond the second end surface 7 of the body 2. The shroud 2*a* surrounds the end surface 7 of the body 2, and defines a prismatic internal recess which corresponds in shape and size to the recess of the equipment plug. In this embodiment, the second end surface 7 is provided with an earth pin 8, and with two further pins 24 and 25 which are shaped and positioned so as to be able to enter live and neutral recesses of a cord socket. The pins 24 and 25 may be formed from the same material as the body 2 and shroud 2*a*, and are preferably electrically insulating. Since the shroud 2*a* ensures correct alignment of the adaptor and cord socket, pins 24 and 25 may be omitted in embodiments provided with the shroud 2*a*.

As can be seen in FIG. 6, the end surface 3 of the body 2 is provided with three recesses 4, 5 and 6 as before, and an electrical connection is made between the earth pin 8 of the adaptor and a contact within the recess 5.

On the top of the adaptor, as seen in FIGS. 5 and 6, is an electrically conductive attachment 26. The attachment 26 is connected to the conductor 9 which extends between the earth pin 8 and the recess 5. The purpose of the attachment 26 is to provide a reliable point for a repair operative to attach his earth cord.

The adaptor of FIGS. 5 and 6 is used in the same way as that of FIGS. 1 to 3, except that when the adaptor is in position, the operative need not search the equipment for an appropriate place to connect his personal earthing lead to the equipment chassis. He simply connects his earthing lead to the attachment 26, and thus the time which would have been spent in searching for the appropriate connection point is saved.

The attachment 26 may take any convenient form, such as a pin, to which an alligator clip may be fastened, a socket or a press stud. More than one such connection may be provided, so that the attachment is compatible with whatever connector the operative has on his personal earthing lead.

Figure 7:
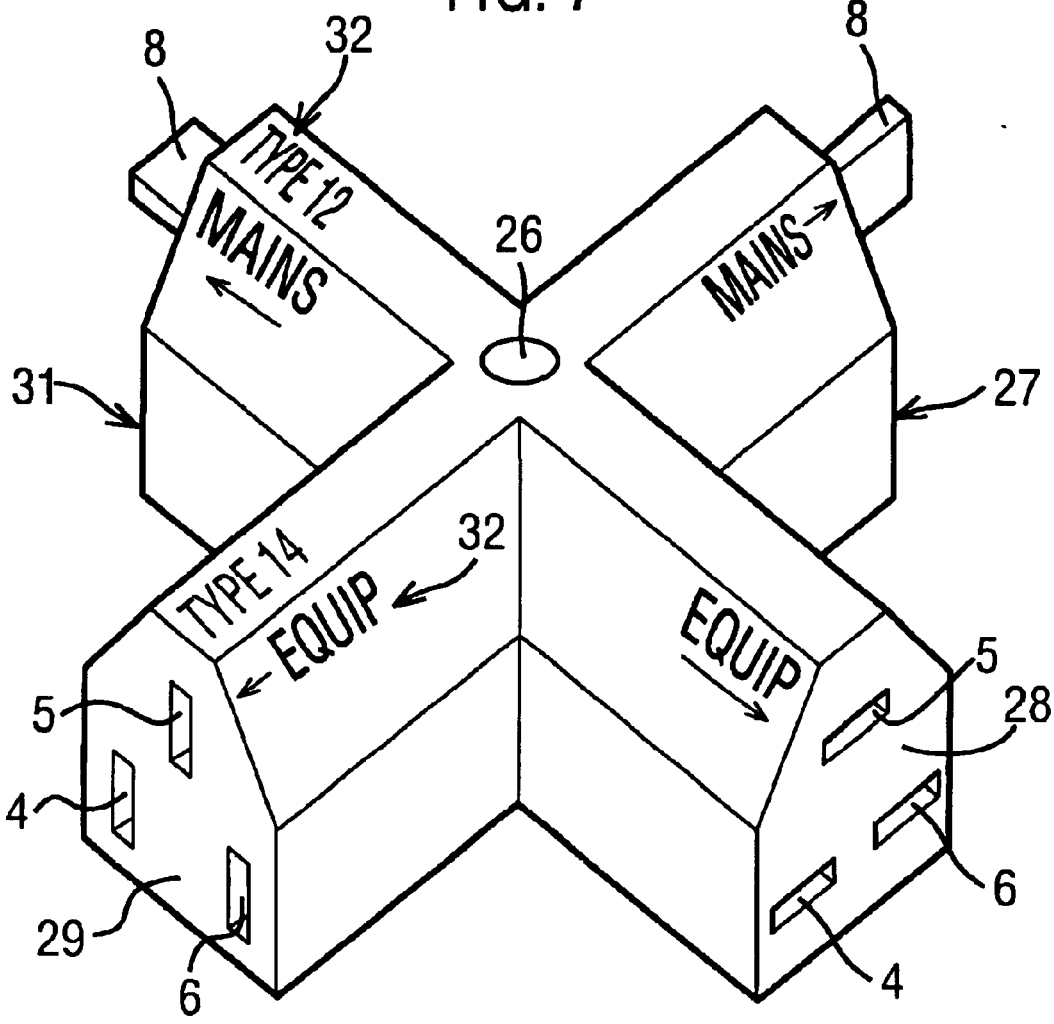
FIG. 7 is a perspective view of a third adaptor, suited to two different types of connector.

FIG. 7 illustrates an adaptor similar to that of FIG. 1, but compatible with two different types of connector commonly found in electrical equipment. The adaptor is generally cruciform in shape, and is generally formed by two elongated and interpenetrated bodies 2 of the type shown in FIGS. 1 and 2. The adaptor of FIG. 7 comprises first to fourth radially facing surfaces 27, 28, 29 and 31 respectively. Surfaces 27 and 31 correspond to the second end surface of the adaptor of FIG. 1, and end surfaces 28 and 29 correspond to the end surface 3 of the adaptor of FIG. 1. In the embodiment shown in FIG. 7, the end surface 28 comprises three generally rectangular recesses arranged substantially horizontally (as seen in the Figure) and the end surface 31 has an earth pin 8 of a generally flat rectangular cross-section. In contrast, the end surface 29 has three recesses of generally rectangular cross-section arranged vertically as seen in the Figure, and the surface 27 has an earth pin 8 corresponding in shape, size and orientation to the recess 5 of the surface 29. Conductors (not shown) electrically connect each earth pin 8 to the earth connection 5 diametrically opposite. The two earth pins 8 may also each be connected to both earth connections 5, and optionally also to an earthing socket 26. The adaptor may be provided with indicia 32 to identify the type of connector, and to indicate which end surface should be offered to the equipment and which to the mains side.

Figure 7A:
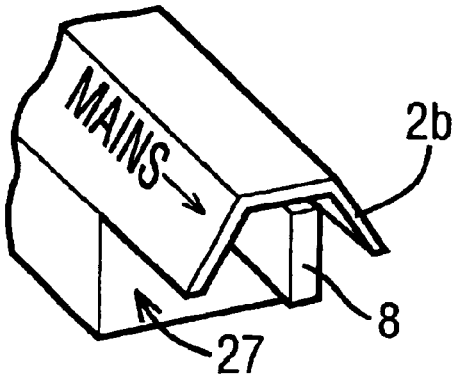
FIG. 7*a* is a partial view of an alternative arrangement of a second end of the adaptor.

FIG. 7*a* shows an alternative structure for the second end surface 27 and earth pin 8 of the adaptor. A partial shroud 2*b* extends round part of the periphery of the second end surface 27 adjacent the earth pin 8, to prevent incorrect connection between the adaptor and a cord socket. The end surface of the cord socket will contact the partial shroud 2*b* if the socket is offered to the adaptor otherwise than in the correct alignment, and entry of earth pin 8 into the live or neutral connections of the cord socket will be prevented.

The use of the connector of FIG. 7 or 7A is similar to that of the connectors of FIGS. 1 to 3 and FIGS. 5 and 6, the only additional step needed by the operative is to select the appropriate ends of the connector 7, prior to offering them up to the equipment plug and the mains cord socket. The adaptor of FIG. 7 is provided at its centre with an attachment socket 26 electrically connected to both earth pins 8, for the service operative to attach his personal earthing cord, in order to avoid the operative having to locate a suitable cord attachment point on the equipment chassis.

FIG. 8 shows an earthing cord 33 for a service operative. The earthing cord 33 comprises a wrist strap 34 provided at its ends with mating fasteners 35*a* and 35*b* for securing the strap 34 around the wrist of the service operative. The wrist strap 34 is electrically conductive, and is electrically connected to one end of an earthing cord 36. As an alternative to a wrist strap, a clip to attach to the operator's clothing or a strap to attach to the operator's finger or ankle may be used, the requirement is for an electrical connection element for connecting to the operative. At the other end of the earthing cord 36 is an adaptor 1 of the type illustrated in FIGS. 1 to 3 or a shrouded adaptor as seen in FIGS. 5 and 6. The earthing cord 36 is electrically connected to the earth pin 8 and to the contact 10 within the recess 5 of the adaptor 1.

When the service operative wishes to service a piece of equipment, he places the wrist strap 34 around his wrist and fastens it with the fasteners 35*a* and 35*b*. The operative then disconnects the cord socket from the equipment plug, and connects the adaptor 1 to the equipment plug and then connects the cord socket to the adaptor 1. The equipment is thus isolated from the mains voltage, and is simultaneously connected to a reliable earth connection. The operative is also reliably connected to earth, via the earthing cord 36 and wrist strap 34. The operative may then work on the electrical equipment, confident that the equipment is protected from electrostatic discharge and the operative is protected from the mains voltage.

Figure 9:
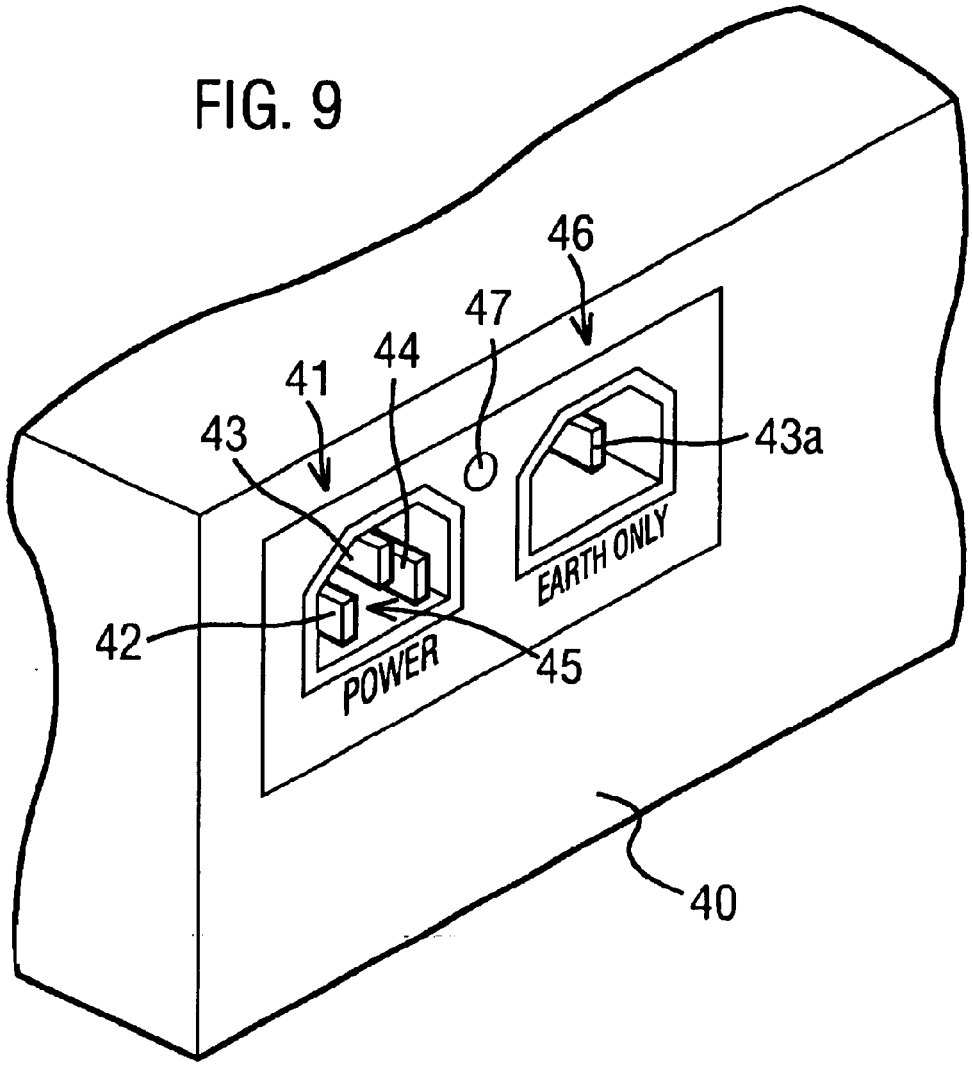
FIG. 9 is a partial perspective view of an equipment enclosure providing alternative connectors.

FIG. 9 illustrates a part of a rear panel of an electrical equipment housing according to a further embodiment of the invention.

The equipment housing 40 is provided with an equipment plug 41 of conventional design, having live, earth and neutral pins 42, 43 and 44 respectively arranged in a prismatic recess 45. The equipment plug 41 is cooperable with a cord socket (not shown) to provide live and neutral power connections and an earth connection to the equipment when in operation.

In addition to the equipment plug 41, a "service" plug 46 is provided on the equipment, the service plug 46 having a configuration similar to the equipment plug 41, but lacking the live and neutral pins 42 and 44 of the equipment plug 41. The "service" plug 46 has only an earth pin 43*a*.

Figure 10:
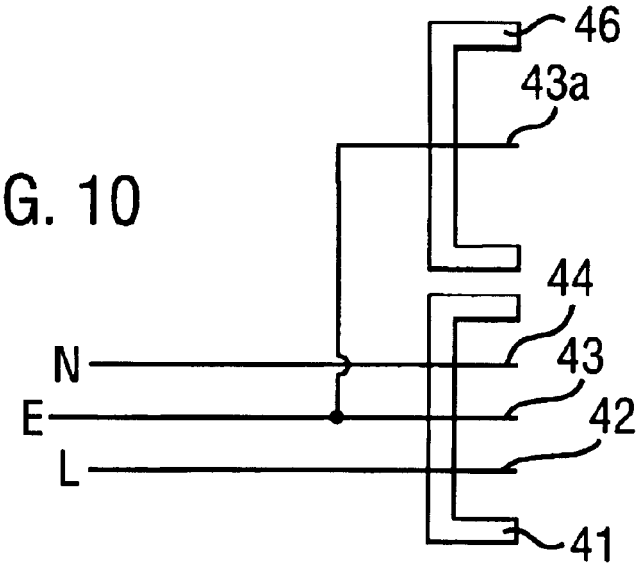
FIG. 10 is a schematic view showing the wiring connections between the connectors of FIG. 9.

FIG. 10 shows the wiring connections between the equipment plug 41 and the service plug 46. The earth pin 43*a* of the service plug 46 is connected to the earth pin 43 of the equipment plug 41.

When a service operative requires to service the equipment within the housing 40, the mains cord socket is removed from the equipment plug 41, and inserted into the service plug 46. In this way, the mains voltage is isolated from the equipment, but a reliable earth connection is preserved. The service operative may then connect his personal earthing cord to the appropriate connection point in the apparatus to protect the equipment from electrostatic discharge. Alternatively, if the equipment plug 41 and service plug 46 are produced as a single unit with the wiring connections pre-established between the earth pins 43 and 43*a*, an attachment point may be provided adjacent the "service" plug 46. The attachment point 47 is electrically connected to the earth pins 43*a* and 43 of the service plug and the equipment plug, and provides a point to which the service operative can attach his personal earthing cord. The provision of the attachment point 47 saves the operative from having to locate a suitable attachment point within the equipment.

FIGS. 11 to 13 show an alternative equipment plug onto which a conventional cord socket may be attached in one of two alternative positions. FIG. 11 is a perspective view of the equipment plug, the plug having a body 50 provided with upper and lower prismatic recesses which partially overlap and join at the centre of the plug body. The lower prismatic recess 51 comprises the lower half of an earth pin 43 mounted centrally between the upper and lower prismatic recesses 51 and 52, respectively. Live and neutral connector pins 42 and 44 respectively are provided in the lower prismatic recess 51.

The upper prismatic recess 52 contains the upper half of the earth pin 43 (as seen in the Figure) only.

The body 50 of the equipment plug is formed at its side edges with a pair of vertical grooves 53 in which a pair of inwardly-directed lips 54 of a channel-sectioned cap member 55 are engageable. In FIG. 11 the cap 55 is shown detached from the body 50, for clarity.

The cap 55 moves between an upper position, shown in FIG. 12 and a lower position shown in FIG. 13.

In the position shown in FIG. 12, the cap 55 substantially covers the upper prismatic recess 52, and a conventional cord socket may be inserted into the lower prismatic recess 51 to engage the three pins 42, 43 and 44 of the equipment plug. The outline of the cord socket is shown in chain line in FIGS. 12 and 13 with the reference 56.

In the position shown in FIG. 13, the cap 55 is moved to a lower position where it substantially covers the lower prismatic recess 51, allowing the cord socket 56 to be inverted and inserted into the upper prismatic recess 52 to engage only the earth pin 43 of the equipment plug.

The cap 55 may be biassed by a spring towards its upper position, as shown in FIG. 12, so that the usual configuration of the equipment plug is to receive the cord socket so as to provide the equipment with power.

When a service operative wishes to service the equipment, the cord socket 56 is removed from the lower prismatic recess 51 of the equipment plug, and the operative moves the cap 55 downwardly to the position shown in FIG. 13, holding it against the resilient bias if necessary. The operative then inverts the cord socket 56, and reinserts it into the upper prismatic recess 52 so that the earth connection of the cord socket engages the earth pin 43 of the equipment plug. The equipment is thus isolated from the mains voltage and connected to the reliable earth of the mains cord.

As an alternative to resiliently biassing the cap 55 towards the normal operating position, the cap 55 may be secured in its upper and lower positions (as shown in FIGS. 12 and 13) by detents or by frictional engagement of the lips 54 with the grooves 53. In a further alternative, the cap 55 may be secured in the position shown in FIG. 12 by means of a screw or other fastener, which is removed by the service operative when the cap 55 is to be moved to the position of FIG. 13.

Indicia may be provided on the cap or on the equipment plug body 50 to indicate the alternative positions of the cap 55 relative to the body 50 for operation and for servicing.

To provide further confidence to the service operative, the adaptors of FIGS. 1 to 7 may be constructed from transparent plastics material, so that the electrical conductive elements are clearly visible to the operative. He can therefore be certain that the appropriate earth connection is made and the mains supply is isolated. Alternatively, the adaptor may be made from brightly coloured material, or from plastics of the same colour or colours as the earth conductors of the mains, to distinguish it as an earth-only device.

In further alternative embodiments of the adaptors of FIGS. 1 to 7, the recesses 4 and 6 and the recesses 19 and 20 of the adaptor may be provided with electrical connection 77 which joins them together, so that the equipment is effectively short-circuited when the adaptor is in use. Such a connection provides the operative with effective protection against stray capacitances or other stored charges being discharged through his earth connection.

In a further alternative the recesses 4 and 6 and 17 and 20 of the adaptors shown in FIGS. 1 to 7 may be connected not only to each other but also to the earth connection by providing electrical connection 88. In this way, the equipment is shorted and earthed, as well as being reliably isolated from the mains voltage so that the equipment is fully protected against stray discharges from the operative, and the operative is likewise protected against discharges from equipment components.

When the operative is using the earth strap of FIG. 8, he will be reminded that the adaptor 1 has been placed in position to isolate the equipment. However, the adaptors of FIGS. 1 to 7 may be forgotten by the operative when he has completed the servicing of the equipment. The adaptors may therefore be provided with an indicator flag to remind the operative that the adaptor is in place and should be removed before the equipment is restarted.

Figure 14:
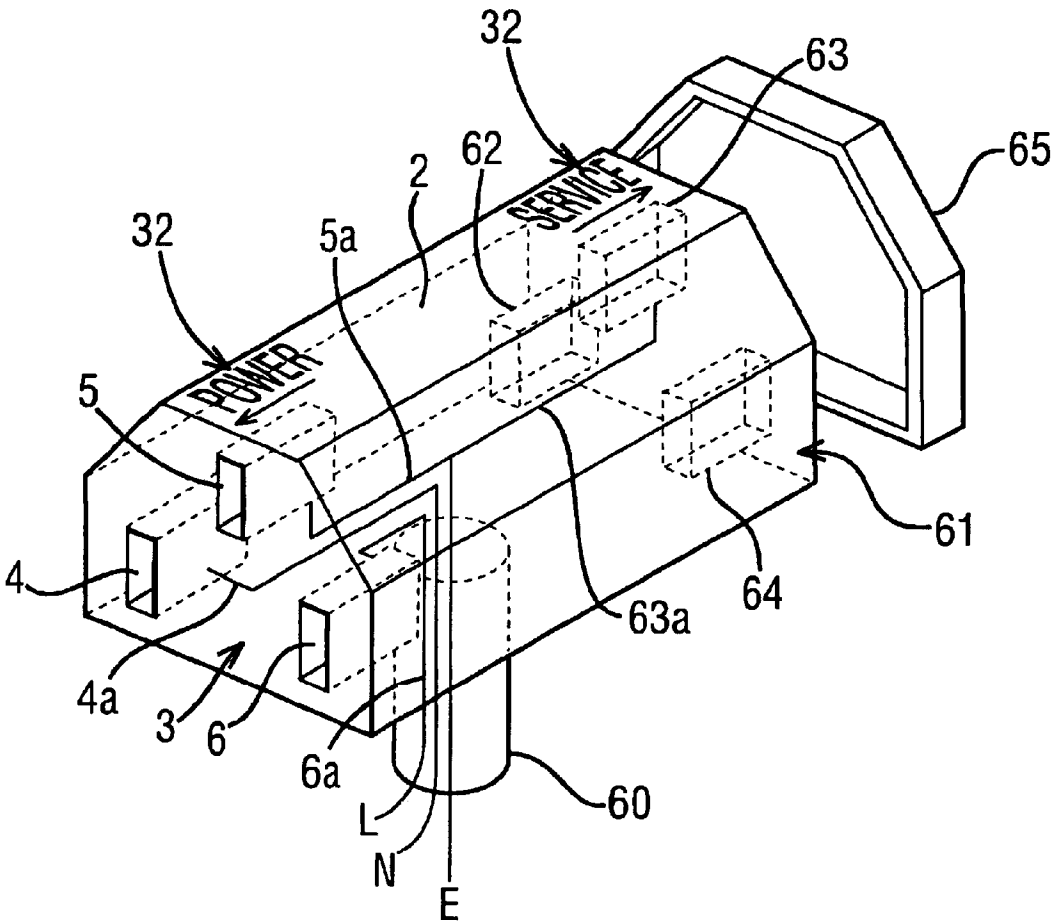
FIG. 14 is a schematic perspective view of a combined power cord socket and earth adaptor.

FIG. 14 shows a combined power cord socket and earth only adaptor, for use with electrical apparatus having a conventional equipment plug or ac inlet.

The adaptor of FIG. 14 comprises a substantially prismatic body 2 having a first end face 3 with recesses 4, 5 and 6 to receive the neutral, earth and live pins of the ac inlet of the equipment. Electrical connectors 4*a*, 5*a* and 6*a* respectively connect the recesses 4, 5 and 6 to the live, earth and neutral cores of a mains cable 60 which enters the body 2 of the adaptor through its lower face (as seen in the Figure). The mains cable 60 is connected at its other end to a mains plug (not shown) for connection to the local mains supply.

The body 2 of the adaptor of FIG. 14 has a second end face 61 opposite the first end face 3. Since the body 2 of the adaptor is prismatic in form, the second end face 61 has the same outline as the first end face 3, and is thus receivable in a conventional ac inlet. The end face 61 is provided with three recesses 62, 63 and 64, to receive the live, earth and neutral pins of the ac inlet or equipment plug. The earth recess 63 is connected by a conductor 63*a* to the earth recess 5 at the first end of the adaptor, and to the earth core of the mains cable 60. The recesses 62 and 64 of the second end 61 of the adaptor may be electrically connected together by a conductor (not shown).

A cap 65 may optionally be provided with the adaptor to cover the end face of the adaptor which is not in use.

The adaptor of FIG. 14 is intended for use with electrical apparatus having a conventional ac inlet, and in a first configuration, the first end 3 of the adaptor is introduced into the ac inlet and thus electrical contact is made with all three of the pins of the equipment plug and power is supplied to the apparatus. An effective earth connection is also made through the earthing recess 5. The second end surface 61 of the adaptor will extend out of the ac inlet, and may be covered by the cap 65.

When an operative requires to service the apparatus, the cap 65, if present, is removed from the second end face 61 of the adaptor. The adaptor is then pulled out of the ac inlet of the apparatus and reversed, so that the second end face 61 is then offered up to the ac inlet of the apparatus. By inserting the second end face 61 into the ac inlet, an earth connection is made via the earth recess 63 of the second end 61 of the adaptor. The live and neutral pins of the ac inlet (equipment plug) are received in the recesses 62 and 64 of the second end face 61 of the adaptor and are electrically isolated from the mains supply. The live and neutral pins of the apparatus plug may be short-circuited if a conductor is provided between the recesses 62 and 64. The cap 65 may then be placed over the first end face 3 of the adaptor, to prevent the introduction of any tools or foreign bodies into the live and neutral recesses 4 and 6 of the first end face 3 of the adaptor.

The adaptor shown in FIG. 14, if substituted for the conventional cord socket, enables electrical apparatus to be serviced safely by isolating the apparatus from the mains voltage but simultaneously maintaining a reliable earth connection through the power cord of the apparatus.

An earth attachment point (not shown) may be provided on the adaptor of FIG. 14, to avoid the operative having to seek an appropriate point on the apparatus, and/or to save the equipment manufacturer the expense of providing an earthing point.

Indicia 32 may be provided on the adaptor body 2 to clearly identify the "power" and "service orientations of the adaptor.

What is claimed is:

1. An adaptor connectable between an inlet of an electrical apparatus having live, neutral and earth contacts and an electricity supply outlet having live, neutral and earth contacts, the adaptor comprising:

a first interface compatible with the inlet of the electrical apparatus and having an earth contact adapted to make electrical connection with the earth contact of the inlet, wherein said first interface also includes a live contact and a neutral contact;

a second interface compatible with the electricity supply outlet and having an earth contact adapted to make electrical contact with the earth contact of the electricity supply outlet, wherein said second interface also includes a live contact and a neutral contact;

an electrical conductor connecting the earth contact of the first interface with the earth contact of the second interfaces; and electrical insulation for electrically isolating the live, neutral, and earth contacts of the first interface from the live and neutral contacts of the second interface.

2. The adaptor according to claim 1, wherein the first and second interfaces are formed on opposing faces of an adaptor body.

3. The adaptor according to claim 2, wherein the first and second interfaces are formed at opposite ends of an elongate adaptor body.

4. The adaptor according to claim 1, wherein an electrical connection is included between the live and neutral contacts of the first interface.

5. The adaptor according to claim 4, wherein the earth contact of the first interface is electrically connected to the live and neutral contacts of the first interface.

6. A method of effecting a service operation on an electrical apparatus having a power inlet with live, neutral and earth contacts for receiving power from an electrical supply outlet having live, neutral and earth contacts, the method comprising:

disconnecting the live, neutral and earth contacts of the power inlet from those of the electrical supply outlet;

connecting the earth contact of the power inlet to the earth contact of the electrical supply outlet using an adaptor comprising:

a first interface compatible with the power inlet of the electrical apparatus and having an earth contact adapted to make electrical connection with the earth contact of the inlet, wherein said first interface also includes a live contact and a neutral contact;

a second interface compatible with the electrical supply outlet and having an earth contact adapted to make electrical contact with the earth contact of the electrical supply outlet, wherein said second interface also includes a live contact and a neutral contact;

an electrical conductor connecting the earth contact of the first interface with the earth contact of the second interfaces; and electrical insulation for electrically isolating the live, neutral, and earth contacts of the first interface from the live and neutral contacts of the second interfaces;

carrying out the service operation.

* * * * *